US005803371A

United States Patent [19]

Sugiyama et al.

[11] Patent Number: 5,803,371

[45] Date of Patent: Sep. 8, 1998

[54] INJECTION NOZZLE

[75] Inventors: Tamotsu Sugiyama; Haruhide Tanaka; Kenichi Okabe, all of Tomakomai; Takayuki Ishihara, Okazaki; Yasuhiro Kishi, Yotsukaidou; Toyofumi Kanamaru, Sagamihara, all of Japan

[73] Assignees: Toyota Jidosha Kabushiki Kaisha, Toyota; Toyota Motor Hokkaido Inc., Tomakomai; Spraying Systems Japan Co., Tokyo, all of Japan

[21] Appl. No.: 744,459

[22] Filed: Nov. 7, 1996

[51] Int. Cl.[6] ..... B05B 1/14

[52] U.S. Cl. ..... 239/555; 239/568

[58] Field of Search ..... 239/548, 554, 239/556, 557, 562, 568, 107, 106, 600, 555, 553, 455, 451

[56] References Cited

FOREIGN PATENT DOCUMENTS

A-1-317561 12/1989 Japan .

*Primary Examiner*—Andres Kashnikow
*Assistant Examiner*—David Deal
*Attorney, Agent, or Firm*—Oliff & Berridge, PLC

[57] ABSTRACT

An injection nozzle for blowing air or injecting solvents reduces noise level and facilitates cleaning of injection passages. The injection nozzle includes a nozzle body provided with an opening and an inlet passage communicating with the opening. A plurality of grooves are provided on top and bottom sides of the nozzle body respectively. The nozzle body is also provided with upper and lower cover members, which can be selectively opened or closed. When the cover members are closed, an expansion chamber is defined by the opening and injection passages are defined by the grooves. The fluid to be injected from the inlet passage is expanded once in the expansion chamber and is then distributed through the injection passages for injection. Such expansion and contraction produces an effect of reducing noise level at the time of injection. Furthermore, the insides of the expansion chamber and the injection passages can be cleaned with ease by opening the cover members.

5 Claims, 9 Drawing Sheets

| Test items \ Nozzle type | | Pipe nozzle (Φ6 inner diameter) | Injection nozzle of the present invention | Effect |
|---|---|---|---|---|
| Air pressure (kgf/cm) | | 4 | 4 | |
| Air flow rate (l/min) | | 1370 | 923 | 32.6% |
| Noise (dBA) | Measuring point B | 106.0 | 90.5 | Δ15.5 |

INJECTION NOZZLE

BACKGROUND OF THE INVENTION

1. Field of the Invention

The present invention relates to an injection nozzle for blowing or spraying compressed air, solvents, etc.

2. Description of Prior Art

An injection nozzle for the blowing air to various work pieces, molds, etc. or spraying of mold lubricant to die casting molds, is known. For example, a pipe nozzle 1 having an inner diameter of 6–8 mm as shown in FIG. 18 has been used. The base portion of the pipe nozzle 1 is provided with a tapered screw portion 2 for connection to the piping from the supply source of the fluid to be injected such as compressed air, solvent, etc.

Another type of injection nozzle is as disclosed in Japanese Patent Laid-Open Hei No. 1-317561. It has a nozzle body with an expansion chamber formed therein and a plurality of injection holes arranged in a row communicating with the nozzle inlet through the expansion chamber. In such an injection nozzle, any of the fluids to be injected such as the compressed air, solvent, etc. is expanded once in the expansion chamber and distributed among the plural injection holes. This allows not only the injection speed to be increased to improve the blow effect but also the noise at the time of injection to be reduced.

FIG. 19 shows a high-pressure die casting machine equipped with an injection nozzle as described above. The high-pressure casting machine 3 as shown in FIG. 19 is a die casting machine dedicated to the manufacture of the aluminum alloy wheels for automobiles, wherein an injection unit 4 for the spray of the mold lubricant and air blow is joined to the end of a swing arm 5. The injection unit 4 is made to move back and forth between an upper die 6 and a lower die 7 in accordance with the operating movement of the swing arm 5. The injection unit 4 has a plurality of air blow nozzles 8 and mold lubricant injection nozzles 9 pivotally provided thereon, confronting both the upper and lower dies 6 and 7. With each casting cycle the injection unit 4 is moved to enter between the upper and lower dies 6 and 7, and the air blow nozzles 8 and the mold lubricant injection nozzles 9 are caused to rotate in order to perform the air blow and the spraying of mold lubricant respectively.

The above-described conventional injection nozzles, however, have the following problems.

Since the pipe nozzle 1 as shown in FIG. 18 is provided with a single injection hole having a shape of a pipe, the air blow can be performed by such pipe nozzle 1 only with a low injection speed, therefore, with an insufficient blow effect. This entails problems such as an increase in consumption of compressed air and a high level of noise at the time of injection.

On the other hand, an injection nozzle having a plurality of injection holes and an expansion chamber as disclosed in Japanese Patent Laid-Open Hei No. 1-317561 provides an improved blow effect as well as a reduced injection noise. In this case, however, the size of each injection hole is small, and thus, when used as the injection nozzle for spraying the mold lubricant, the foreign matters such as viscous component, etc. in the solvent tend to deposit inside the injection holes, which causes clogging thereof and resultant decline of injection performance. Especially, when the mold lubricant containing graphite and the like is injected in a high-temperature atmosphere, the viscous component tends to give rise to a problem such as the formation of the deposit inside the injection hole. In such a case, piano wires and the like are inserted into the injection holes to clean them. However, it is not easy to remove such foreign matters completely, since the size of each injection hole is very small.

SUMMARY OF THE INVENTION

The present invention is made in consideration of the foregoing problems of the prior art and with an object of providing an injection nozzle capable of producing a higher blow effect, a greater reduction of noise and a greater ease in cleaning the injection hole.

In order to solve the above-described problems, the injection nozzle according to the present invention is characterized in that the nozzle body is provided with an opening formed through top and bottom sides thereof, an inlet passage communicating with the inside of the opening, a plurality of grooves formed on the top and bottom sides of the nozzle body respectively and extending from the opening towards the outside and cover members pivotally mounted on the top and bottom sides of the nozzle body and designed to define an expansion chamber by closing the opening and injection passages by closing the grooves.

With the above-described arrangement, when the cover members are closed, the expansion chamber and the injection passage are formed. The fluid to be injected, which has flown into the inside of the nozzle body through the inlet passages, is once expanded in the expansion chamber and injected outside through the injection passages. Since the injection passages and the expansion chamber are defined by the opening, the grooves and the cover members, the inside thereof can easily be cleaned by opening the cover members.

DESCRIPTION OF PREFERRED EMBODIMENTS

In the following, preferred embodiments of the present invention will be described in detail with reference to the accompanying drawings.

Figure 1:
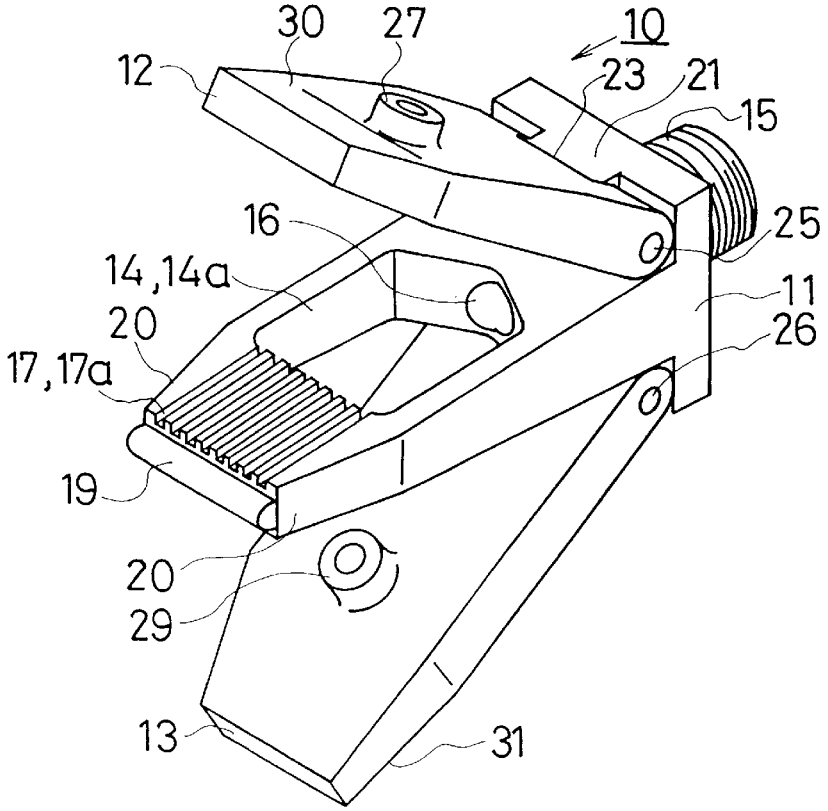
FIG. 1 is a perspective view showing an injection nozzle with the cover members opened according to an embodiment of the present invention.
Figure 2:
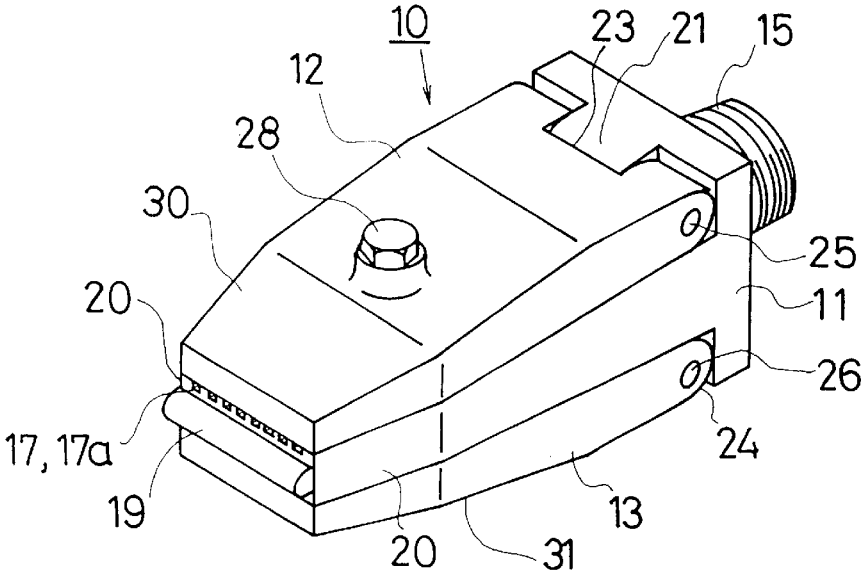
FIG. 2 is a perspective view showing the device of FIG. 1 with the cover members closed.
Figure 3:
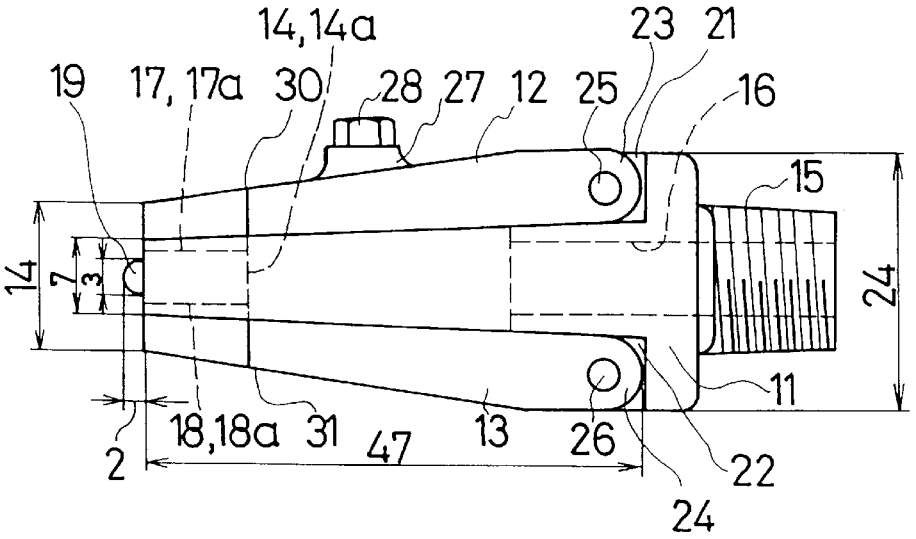
FIG. 3 is a side view showing the device of FIG. 1 with the cover members closed.
Figure 4:
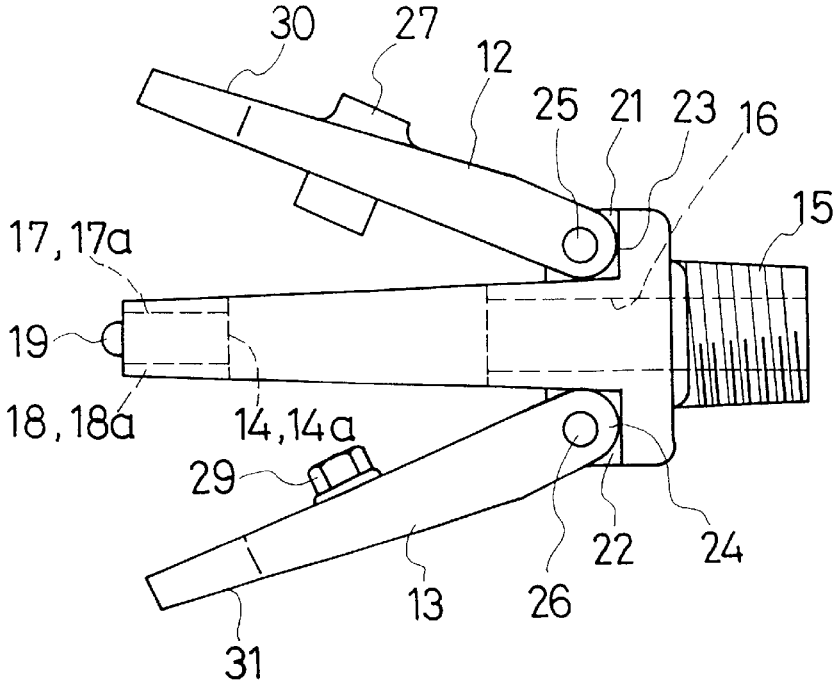
FIG. 4 is a side view showing the device of FIG. 1 with the cover members opened.

As shown in FIGS. 1 to 4, an injection nozzle 10 substantially comprises a nozzle body 11 and upper and lower cover members 12 and 13 pivotally mounted on top and bottom sides of the nozzle body 11 respectively. FIG. 1 and FIG. 4 show the upper and lower cover members 12 and 13 which are both in the opened state. FIG. 2 and FIG. 3 show the upper and lower cover members 12 and 13 which are both in the closed state.

Figure 5:
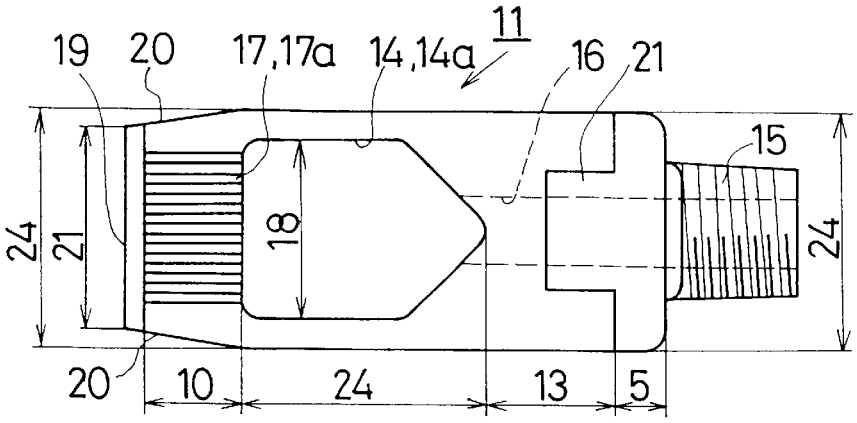
FIG. 5 is a plan view of the nozzle body of the device of FIG. 1.
Figure 6:
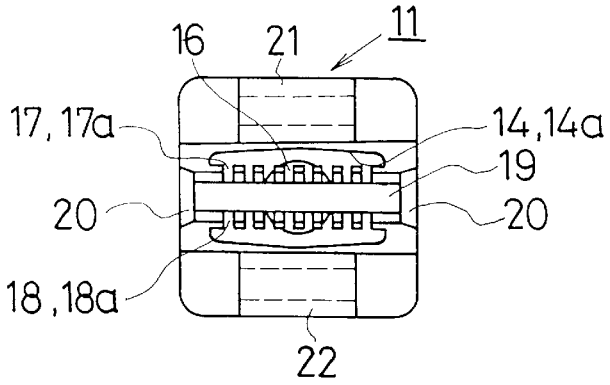
FIG. 6 is a front view of the nozzle body of the device of FIG. 1.

The nozzle body 11 has a substantially T-shaped cross section with a base portion thereof projecting in opposite directions. In the middle of the nozzle body 11 there is provided a substantially pentagonal opening formed through the top and bottom sides thereof. The base portion of the nozzle body 11 is provided with a tapered screw portion 15 for connection with a supply source of fluid to be injected such as compressed air, solvent, etc. An inlet passage 16, extending from the tapered screw portion 15 towards the front end of the nozzle body 11, communicates with an opening 14. On top and bottom side surfaces of the front portion of the nozzle body 11, there are formed a plurality of parallel grooves 17 and 18 respectively (8 grooves are formed on each of the top and bottom side surfaces in an example as shown in the figure). FIG. 5 shows a plan view of the nozzle body 11, and FIG. 6 the front view of the same.

At the front end of the nozzle body 11, there is formed a noise deadening convex portion 19 between openings of the grooves 17 provided on the top side and those of the grooves 18 provided on the bottom side. The front portion of the nozzle body 11 is provided with inclined sides 20 on both left and right sides thereof so that the thickness of the front portion is gradually reduced towards the front end thereof. On the projecting portions formed on the both top and bottom sides of the nozzle body 11, there are provided mounting bases 21 and 22 for mounting the upper and lower cover members 12 and 13 respectively thereon so that they can be selectively opened or closed.

On the base portions of the upper and lower cover members 12 and 13, there are formed mounting portions 23 and 24 to be engaged with the mounting bases 21 and 22 of the nozzle body 11 respectively. Pins 25 and 26 are passed through the mounting bases 21 and 22 of the nozzle body 11 and the mounting portions 23 and 24 of the upper and lower cover members 12 and 13 respectively so that the upper and lower cover members 12 and 13 are pivotally supported on the nozzle body 11. When the upper and lower cover members 12 and 13 are turned, they will be closed eventually as shown in FIGS.2 and 3. That is, bringing the cover members 12 and 13 into close contact with the top and bottom side surfaces of the nozzle body 11 respectively will cause the opening 14 to be closed to form an expansion chamber 14*a* communicating with an inlet passage 16 and the grooves 17 and 18 to be closed to form a plurality of linear injection passages 17*a* and 18*a* respectively (8 grooves are formed on each of the top and bottom side surfaces in an example as shown in the figure).

The upper and lower cover members 12 and 13 are designed to be fixed to the nozzle body 11 as they are closed by inserting a bolt 28 into a hole of a boss portion 27 provided at a central portion of the upper cover member 12 and screwing the bolt 28 into a nut 29 fixed to a central portion of the lower cover member 13. The upper and lower cover members 12 and 13 are formed so that their contacting surfaces with the nozzle body 11 coincide respectively with the top and bottom surfaces of the nozzle. The front portions of the cover members 12 and 13 are provided with inclined sides 30,31 respectively so that the thickness of each of the front portions is gradually reduced towards the front end thereof.

Operation of the thus-constructed embodiment will be described below.

The tapered screw portion 15 of the nozzle body 11 is connected to a piping (not shown) from a supply source of fluid to be injected such as compressed air, solvent, etc., and the injection nozzle 10 is connected to a body of an injection device (not shown) such as a high-pressure die casting machine.

As shown in FIG. 2 and FIG. 3, the upper and lower cover members 12 and 13 are closed and fixed to the nozzle body 11 with the bolt 28, whereby the opening 14 and the grooves 17 and 18 are closed to form the expansion chamber 14*a* and the injection passages 17*a* and 18*a* respectively.

If the fluid to be injected has been supplied to the inlet passage 16 from the supply source, it enters the expansion chamber 14*a* and is distributed among the injection passages 17*a* and 18*a* to be injected. In this process, since the fluid to be injected is expanded once in the expansion chamber 14*a* and is then distributed among the injection passages 17*a* and 18*a* having a small cross section, the noise-deadening effect produced by such expansion and contraction of the fluid serves to reduce the injection noise.

As described above, the noise-deadening convex portion 19 is provided between the openings of the injection passages 17*a* and 18*a* which are disposed on the top and bottom sides of the nozzle body 11 respectively, and the front portion of the nozzle body 11 is provided with inclined sides 20 on both the left and right sides thereof. Further, the front portions of the upper and lower cover members 12 and 13 have inclined sides 30 respectively. Accordingly, turbulent flow can be effectively prevented from being produced in the vicinity of the front portion of the injection nozzle 10, which reduces the noise and improves the blow effect. Also, since the injection passages 17*a* and 18*a* extend linearly, the fluid to be injected can be concentrated at one point for injection. Thus, the injection pressure can be increased to improve the blow effect. Furthermore, such construction wherein two rows, that is, an upper row and a lower row are formed by the injection passages 17*a* and 18*a* allows a large number of injection passages to be provided in a small space.

As shown in FIG. 1 and FIG. 4, the insides of the expansion chamber 14*a* and the injection passages 17*a* and 18*a* are exposed to the outside by removing the bolt 28 and opening the upper and lower cover members 12 and 13. Accordingly, the insides of the expansion chamber 14*a* and the injection passages 17*a* and 18*a* can be cleaned easily with a brush and the like. Thus, even if the deposition of foreign matters such as the viscous component of the injected solvent like mold lubricant causes the injection passages 17*a* and 18*a* to be clogged, the foreign matters in the injection passages 17*a* and 18*a* can be removed easily and completely.

As described in the foregoing, the injection nozzle according to the present invention is capable of providing a high blow effect and an low-noise operation and makes it easier to clean the expansion chamber 14*a* and the injection passages 17*a* and 18*a*. Therefore, it is applicable to an injection device for a variety of purposes such as spraying of mold lubricant to dies, or air blow for removing dust, water drops, etc.

Figure 7:
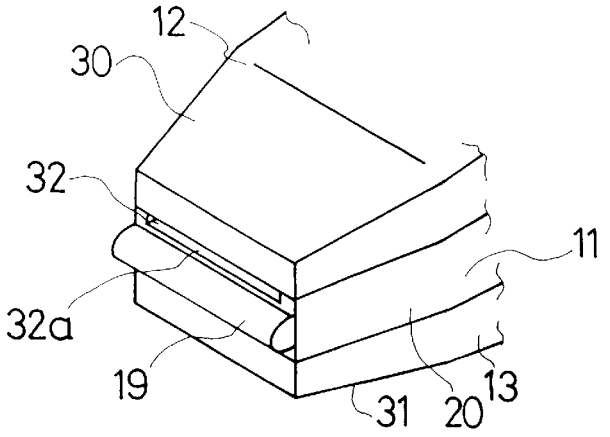
FIG. 7 is a perspective view showing another embodiment of the injection passages of the device of FIG. 1.

In the foregoing embodiment, the nozzle body 11 is provided with a plurality of thin and long grooves 17 and 18 so as to form a plurality of injection passages 17*a* and 18*a*. However, the plurality of grooves 17 and 18, that is, the injection passages 17*a* and 18*a* may be replaced with a single groove, that is, a single passage. Also, as shown in FIG. 7, a wide groove 32 (only one provided on the top side is shown and will be shown hereinafter.) may be provided on each of the top and bottom sides of the nozzle body 11 to form a flat injection passage 32*a*.

Next, other embodiments of the present invention will be described with reference to FIGS. 8 to 13. In the following description, the same reference numerals are assigned to members similar to those as shown in FIGS. 1 to 7. Only members different from those as shown in FIGS. 1 to 7 will be described in detail.

Figure 8:
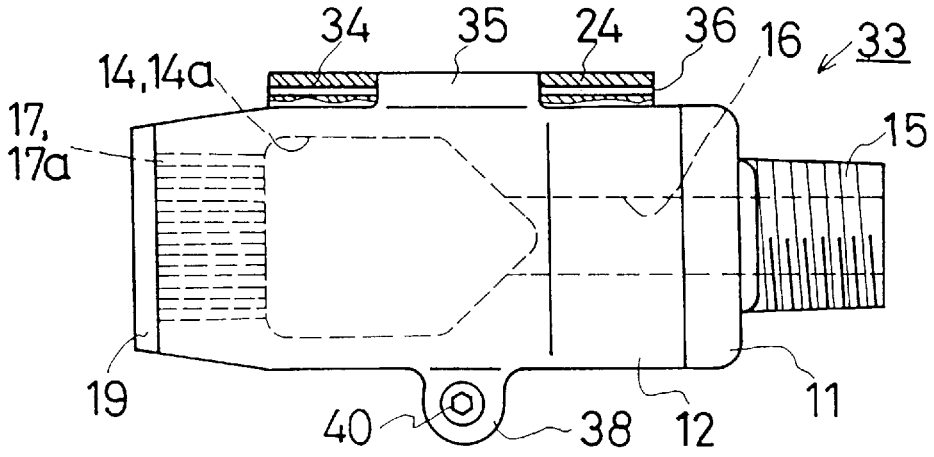
FIG. 8 is a plan view of another embodiment of the present invention.
Figure 9:
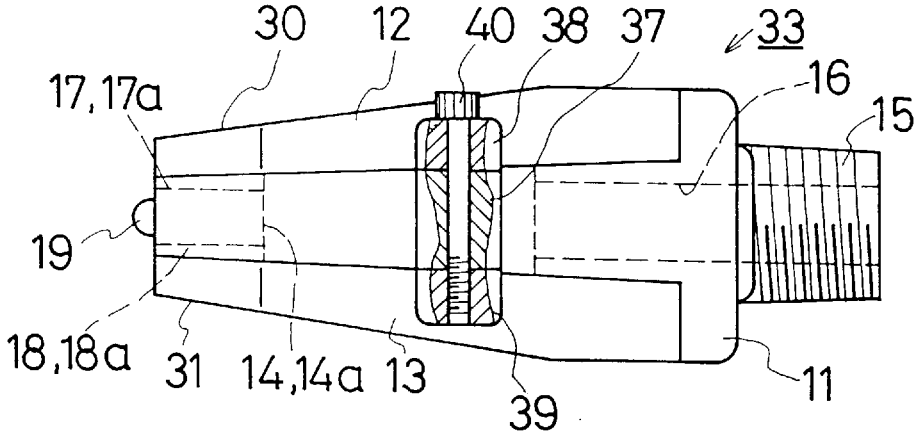
FIG. 9 is a side view of the device of FIG. 8.

An injection nozzle 33 as shown in FIGS. 8 and 9 has mounting bases 34 provided on top and bottom sides of the nozzle body 11 (only one provided on a top side is shown and will be shown hereinafter). The mounting bases 34 are engaged with mounting portions 35 formed on side surfaces of the upper and lower cover members 12 and 13, and a pin 36 is passed through the mounting base 34 and the mounting bases 35 for allowing pivotal support thereof. Thus, the upper and lower cover members 12 and 13 can be mounted on the nozzle body 11 so that they can be selectively opened or closed. The upper and lower cover members 12 and 13, which are in the closed state, can be secured to the nozzle body 11 by inserting a bolt 40 into boss portions 37, 38 and 39 formed on the nozzle body 11 and the opposite sides of the upper and lower cover members 12 and 13 respectively.

Figure 10:
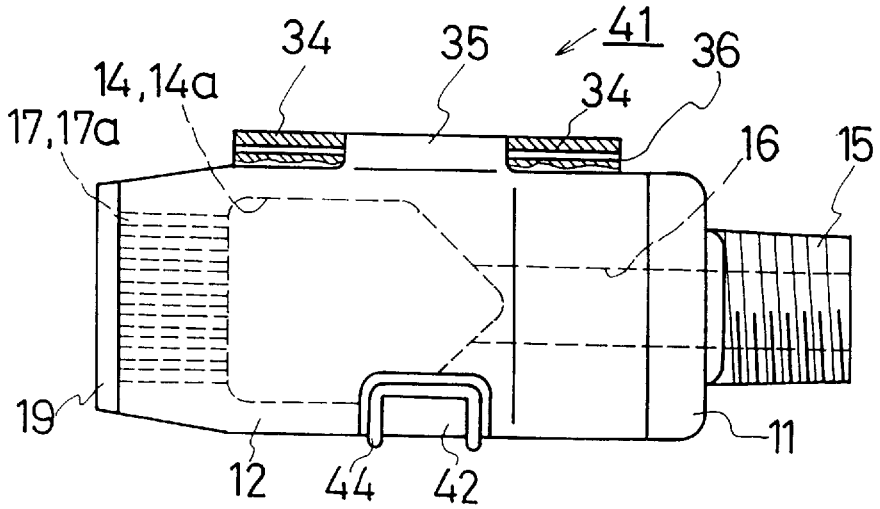
FIG. 10 is a plan view of still another embodiment of the present invention.
Figure 11:
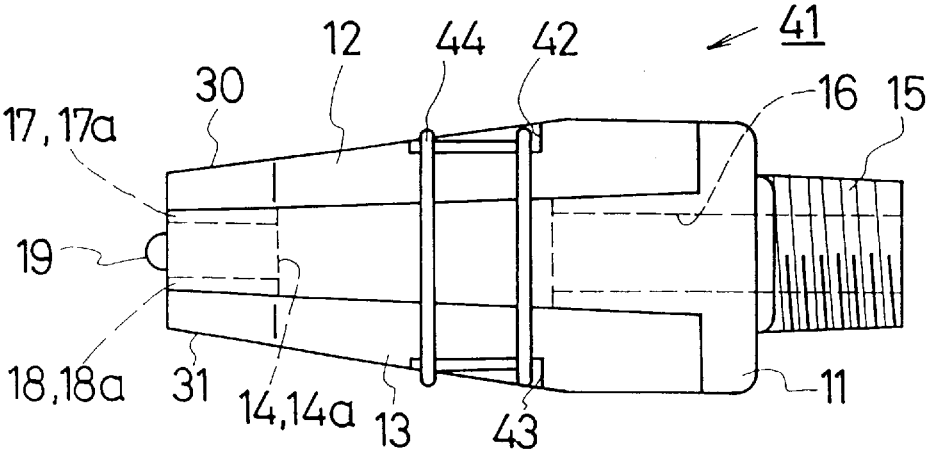
FIG. 11 is a plan view of the device of FIG. 10.

According to an injection nozzle 41 as shown in FIGS. 10 and 11, unlike the injection nozzle 33 as shown in FIGS. 8 and 9 provided with the boss portions 37, 38, 39 and the bolt 40, the upper and lower cover members 12 and 13 are provided with concave portions 42 and 43 having flat surfaces parallel to each other. The upper and lower members 12 and 13 are securely clamped by substantially C-shaped spring members 44 fitted into the concave portions 42 and 43.

Figure 12:
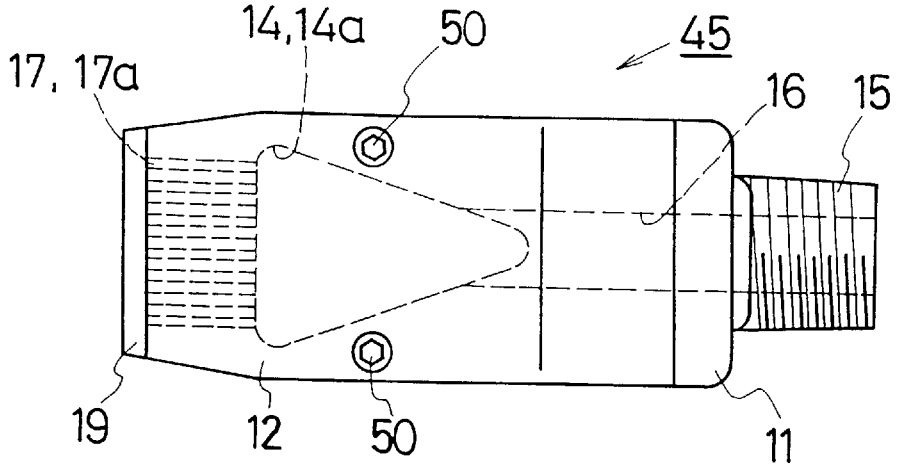
FIG. 12 is a plan view of still another embodiment of the present invention.
Figure 13:
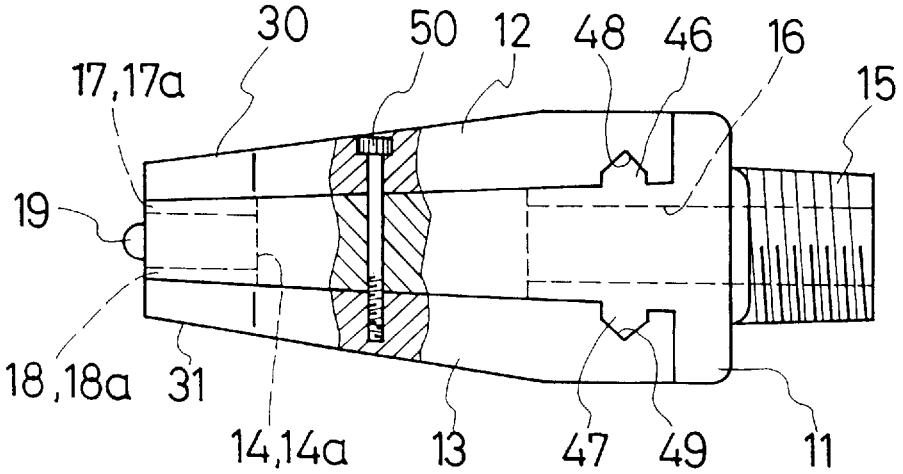
FIG. 13 is a side view of the device of FIG. 12.

Furthermore, according to an injection nozzle 45 as shown in FIGS. 12 and 13, the upper and lower cover members 12 and 13 are held in place to be closed by engaging convex portions 46 and 47 provided on the sides of the nozzle body 11 with concave portions 48 and 49 provided on the sides of the upper and lower members 12 and 13 respectively. The upper and lower cover members 12 and 13 are joined to and secured to each other by directly inserting two bolts 50 through the nozzle body 11 and the upper and lower cover members 12 and 13. Also, as is shown in FIGS. 12 and 13, the opening 14, that is, the expansion chamber 14*a* of the nozzle body 11 has a triangular shape, but it may have a pentagonal shape like the other embodiments.

Next, the result of a performance test conducted for the embodiments as illustrated in FIGS. 1 to 6 will be explained with reference to FIGS. 14 to 17.

The principal parts of the injection nozzles tested have dimensions as shown in FIGS. 3 and 5. For instance, the inner diameter of the inlet passage 16 is 6.0 mm, and the entire cross-sectional area of the injection passages 17*a* and 18*a* is 1.0×1.5 (mm)×16 (pieces).

Figures 14, 15:
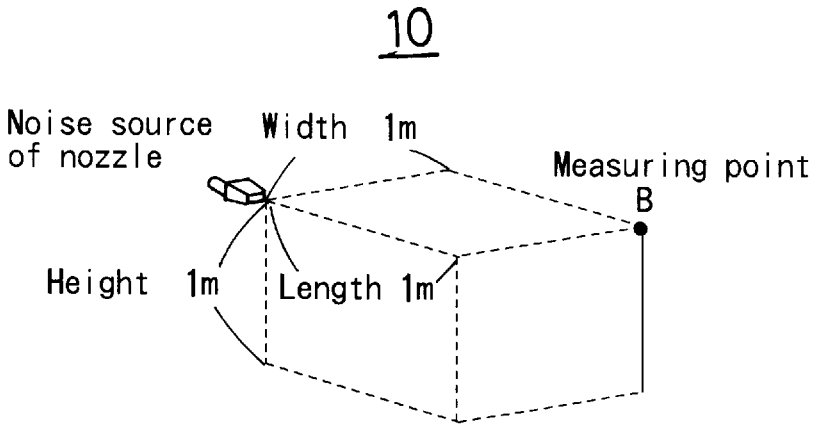
FIG. 14 is a diagram showing measuring points in the noise test of the injection nozzle according to the present invention.
FIG. 15 is a diagram showing the result of the performance test of the injection nozzle according to the present invention.
Figure 18:
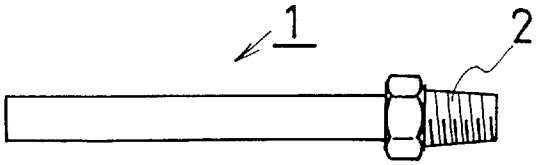
FIG. 18 is a side view of a conventional pipe nozzle.
Figure 19:
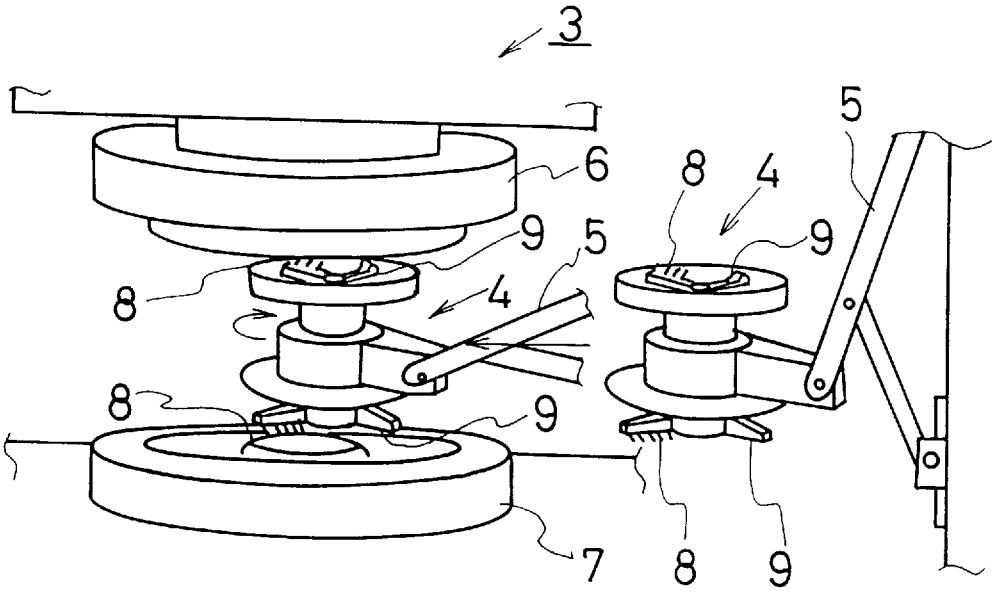
FIG. 19 is a schematic view of a high-pressure die casting machine.

The air flow rate and the noise level are measured at point B as shown in FIG. 14 when the air is supplied at a pressure of 4.0 kg/cm2. The measured values are compared with those of the pipe nozzle (Refer to FIG. 18) having a inner diameter of 6.0 mm obtained under the same conditions. In this case, the noise level test was performed using a noise level meter NA-29 (Rion), and the measured level of the noise was 56.6 dBA.

The results of measurement of the air flow rate and the noise level (dBA) (average values of all the passages) of the injection nozzle 10 and the pipe nozzle are shown in FIG. 15. As is seen from FIG. 15, if the pipe nozzle is replaced with the injection nozzle 10, the air flow rate can be reduced by 32.6%, and the noise level by 15.5 dBA.

Figure 16:
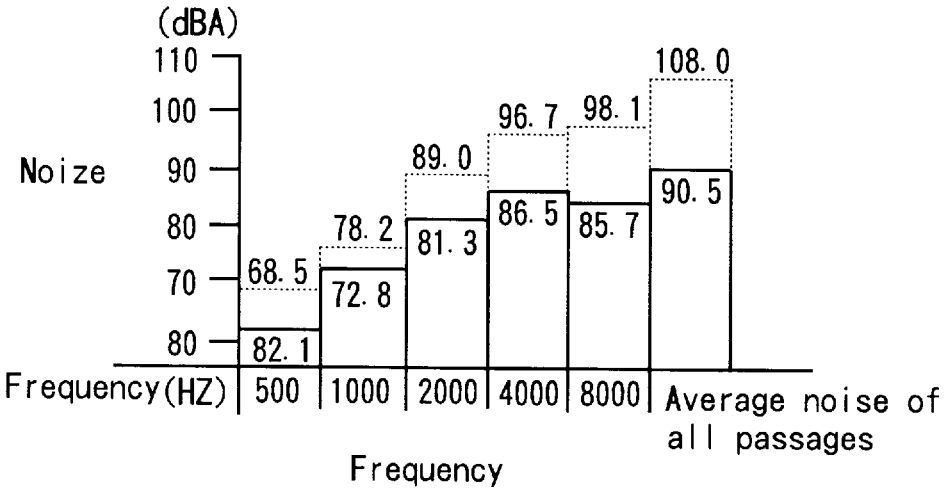
FIG. 16 is a diagram showing values measured at various frequencies in the noise test of the injection nozzle according to the present invention.

The noise levels measured at various frequencies are shown in FIG. 16. In FIG. 16, the measured values of the injection nozzle 10 are represented by a solid line, while those of the pipe line are represented by a broken line. As is seen from FIG. 16, if the pipe nozzle is replaced with the injection nozzle 10, the noise level can be reduced at various frequencies, for example, from 96.7 dBA to 86.5 dBA at 4,000 Hz, a criterion for the loss of auditory perception.

Figure 17:
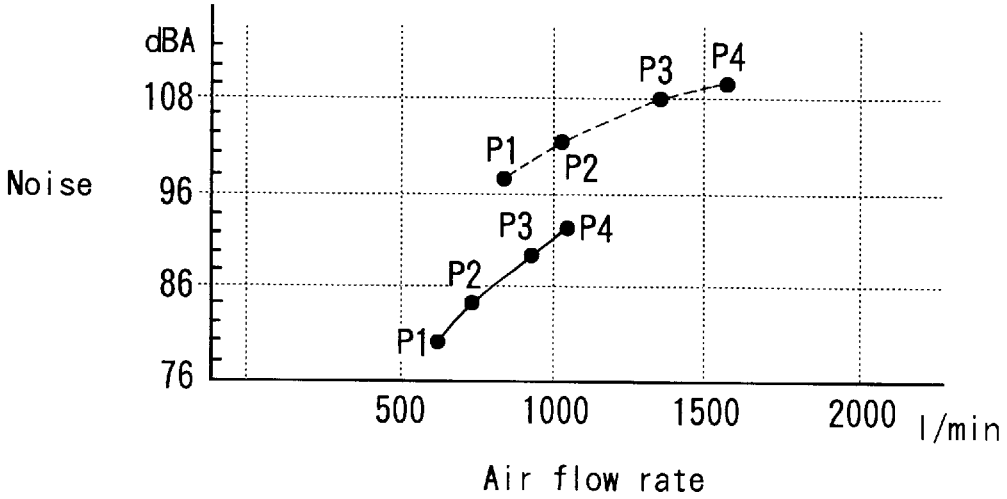
FIG. 17 is a diagram showing a characteristic change in measured values of air flow rate and noise level in dependence upon various pressures of supplied air in the performance test of the injection nozzle according to the present invention.

The results of measurement of the air flow rate and the noise level (dBA) (average values of all the passages) at air pressures of 2–5 atmospheric pressures are shown in FIG. 17. In FIG. 17, the measured values of the injection nozzle 10 are represented by a solid line, while those of the pipe nozzle are represented by a broken line. Points P1, P2, P3 and P4, in the given order, represent the measured values at the air pressures of 2, 3, 4 and 5 atmospheric pressures. As is seen from FIG. 17, if the pipe nozzle is replaced with the injection nozzle 10, the noise level and the air flow rate can be reduced at various air pressures.

As described in detail in the foregoing, according to the injection nozzle of the present invention, the nozzle body is provided with the opening, the inlet passage communicating with the inside of the opening and the grooves extending from the opening to the outside. The cover members for closing the opening to form the expansion chamber and for closing the grooves to form the injection passages are mounted such that they are selectively opened or closed. Thus, when the cover members are closed, the expansion chamber and the injection passages are formed. The fluid to be injected, which has flowed into the inside of the nozzle body through the inlet passage, is expanded once in the expansion chamber and then injected outside through the injection passages. Furthermore, since the injection passages and the expansion chamber are defined by the opening, the grooves and the cover members, the insides thereof can easily be exposed to the outside by opening the cover members. Consequently, the injection nozzle 10 provides an enhanced blow effect and a reduced noise level. In addition, the injection nozzle according to the present invention has a great advantage in that the insides of the injection passages can be cleaned easily by opening the cover members.

What is claimed is:

1. An injection nozzle comprising:

a nozzle body, an opening formed through top and bottom sides of said nozzle body, an inlet passage communicating with the inside of said opening, at least two one-row-grooves formed on said top and bottom sides of said nozzle body respectively and extending from said opening towards outside, and cover members for closing said opening and said grooves to define an expansion chamber and injection passages respectively, wherein said expansion chamber has a cross-sectional area larger than a cross-sectional area of the inlet sufficient for obtaining a reduction in injection noise, and wherein said cover members are selectively opened or closed.

2. An injection nozzle according to claim 1, wherein one of said grooves provided on either of said top or bottom sides of said nozzle body has a plurality of rows.

3. An injection nozzle according to claim 1, wherein said grooves are wide enough to form a flat-shaped injection passages.

4. An injection nozzle according to claim 1, wherein one end of each of said cover members is pivotally supported on said nozzle body, and said cover members are fixed to said nozzle body by means of at least one bolt.

5. An injection nozzle according to claim 1, wherein one end of each of said cover members is pivotally supported on said nozzle body, and said cover members are securely clamped by at least one retaining member to be fixed to said nozzle body.

* * * * *